United States Patent [19]

Wally

[11] Patent Number: 4,507,062

[45] Date of Patent: Mar. 26, 1985

[54] DIAPHRAGM PUMP

[75] Inventor: Michael Wally, Bammental, Fed. Rep. of Germany

[73] Assignee: Chemie und Filter GmbH, Heidelberg, Fed. Rep. of Germany

[21] Appl. No.: 459,785

[22] Filed: Jan. 21, 1983

[30] Foreign Application Priority Data

Jan. 23, 1982 [DE] Fed. Rep. of Germany ..... 3202148

[51] Int. Cl.[3] ..... F04B 9/08; F04B 43/06

[52] U.S. Cl. ..... 417/413; 417/572

[58] Field of Search ..... 417/383, 395, 413, 572

[56] References Cited

U.S. PATENT DOCUMENTS

| | | | |
|---|---|---|---|
| 2,975,599 | 3/1961 | Bennett | 417/383 |
| 3,072,462 | 1/1963 | Anderson | 417/383 |
| 3,288,071 | 11/1966 | Anderson | 417/395 |

FOREIGN PATENT DOCUMENTS 2322764 6/1975 Fed. Rep. of Germany .

OTHER PUBLICATIONS

British Standards Institution, "Electrical Apparatus for Potentially Explosive Atmospheres," 1977.

*Primary Examiner*—Leonard E. Smith
*Assistant Examiner*—Jane E. Obee
*Attorney, Agent, or Firm*—Peter K. Kontler

[57] ABSTRACT

A diaphragm pump, particularly for conveying flammable media, has a housing whose interior is divided into a pumping chamber and a second chamber by a deformable diaphragm having a marginal portion which is clamped between two sections of the pump head and being deformable by a cupped member which is biased in one direction by a coil spring and is movable in the other direction by a plunger receiving motion from a motor and being in mere abutment with the bottom wall of the cupped member. The housing defines a first set of gaps which connect the second chamber with the atmosphere and a second set of gaps which connect the atmosphere with the pumping chamber. The dimensions and shapes of the gaps are such that they do not permit the propagation of ignition from the respective chamber to the atmosphere.

20 Claims, 1 Drawing Figure

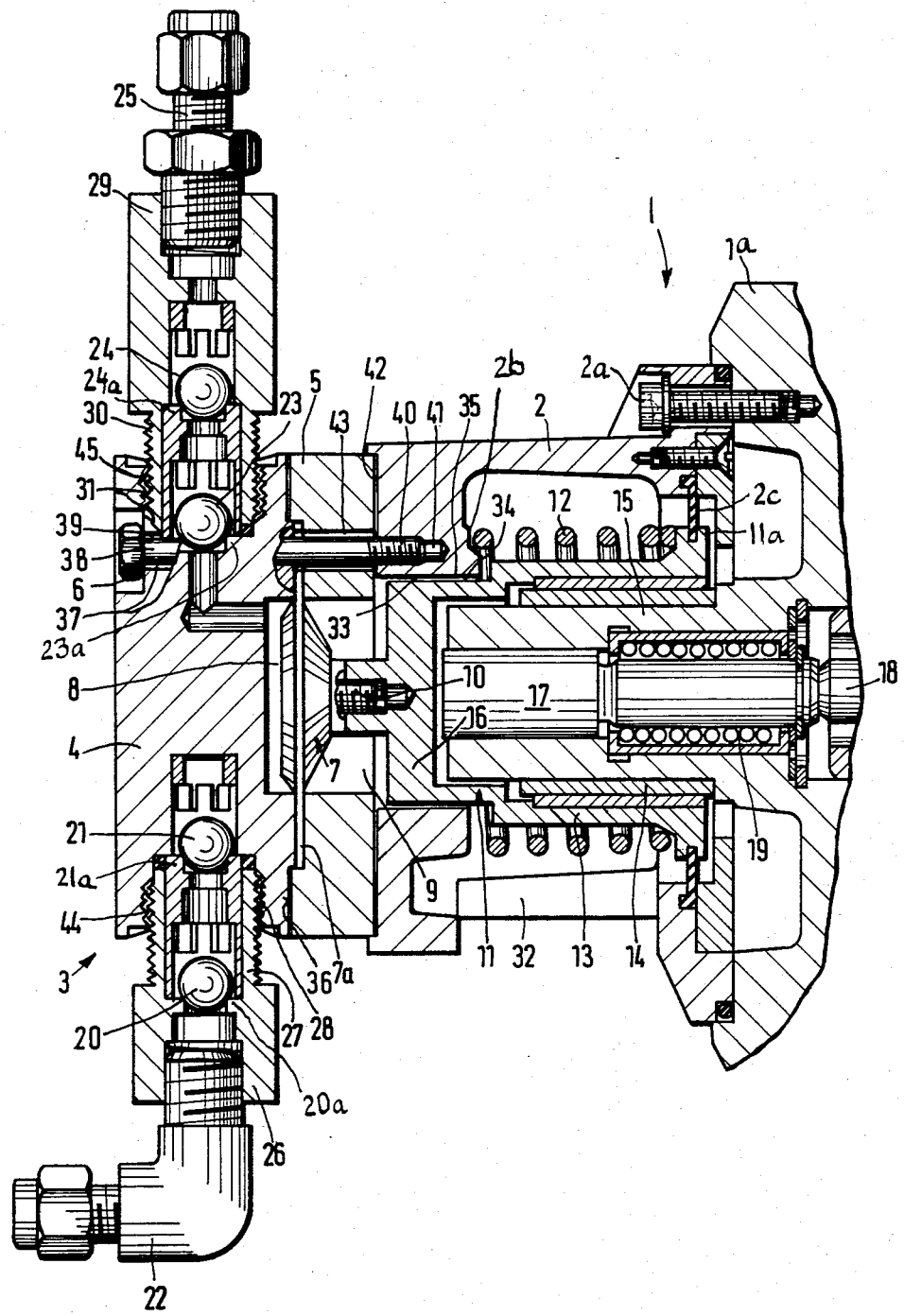
25
29
24
24a
30
45
31
39
38
6
37
23a
8
4
21
21a
44
3
20
22
26
20a
27
28
36
7a
23
5
43
42
40
41
35
2b
2
2a
1
1a
34
12
15
2c
11a
33
10
17
16
7
9
11
32
13
14
19
18

DIAPHRAGM PUMP

BACKGROUND OF THE INVENTION

The present invention relates to fluid flow machines in general, and more particularly to improvements in diaphragm pumps. Still more particularly, the invention relates to improvements in diaphragm pumps which are designed to convey flammable gaseous, hydraulic or otherwise flowable media.

It is already known to induce the flow of a flammable medium by resorting to a diaphragm pump wherein the marginal portion of the diaphragm is clamped in the pump housing and divides the interior of the housing into a pumping chamber and a second chamber. The second chamber receives parts of the mechanism which serves to deform the diaphragm so as to alternately increase and reduce the volume of the pumping chamber, i.e., to induce the flow of a medium into the pumping chamber when the volume of the pumping chamber is on the increase and to effect expulsion of a metered quantity of such medium from the pumping chamber when the volume of the pumping chamber is on the decrease. As a rule, the second chamber communicates with the surrounding atmosphere. Reference may be had to German Pat. No. 23 22 764 which discloses a diaphragm pump of the just outlined character. A drawback of the patented pump is that it cannot be used in installations where the penetration of burning media into the atmosphere can result in fires, explosions or similar disasters. This is due to the fact that, once the diaphragm is destroyed or dislodged so that it allows a flammable medium to flow from the pumping chamber into the second chamber, ignition of the medium in the second chamber can propagate itself into the surrounding atmosphere practically without any obstruction. A first explosion in the second chamber triggers a secondary or follow-up explosion in the surrounding atmosphere. Therefore, the usefulness of the patented diaphragm pump is rather limited because it cannot be put to use under circumstances when the propagation of flames or sparks from the second chamber of the pump housing can or is likely to initiate an explosion in the area around the pump.

OBJECTS AND SUMMARY OF THE INVENTION

An object of the invention is to provide a novel and improved diaphragm pump which is constructed and assembled in such a way that it can be used in areas where sparks or flames can lead to explosions and/or fires.

Another object of the invention is to provide a diaphragm pump which is designed to ensure that combustion of flammable media in the second chamber of the pump housing cannot lead to the propagation of ignition to the surrounding atmosphere.

A further object of the invention is to provide a novel and improved housing for use in a pump of the above outlined character.

An additional object of the invention is to provide a diaphragm pump which allows its chambers to communicate with the surrounding atmosphere but not to the extent which is necessary to enable flames or sparks to propagate themselves from the one and/or the other chamber to the surrounding atmosphere.

A further object of the invention is to provide a novel and improved method of preventing explosions in areas wherein flammable media are conveyed by a diaphragm pump and wherein such flammable media are apt to penetrate, under certain adverse conditions, from the pumping chamber into the second chamber and to burst into flames on entry into or during flow toward the second chamber.

An additional object of the invention is to provide the pump with novel and improved means for establishing safe paths for communication between the pumping and/or second chamber on the one hand and the surrounding atmosphere on the other hand.

A further object of the invention is to provide a novel and improved method of securing the deformable diaphragm in the housing of a diaphragm pump, especially in a pump which is designed to supply metered quantities of flammable substances.

The invention is embodied in a diaphragm pump, especially in a diaphragm pump which can be used to deliver metered quantities of flowable fuels or other combustible media. The pump comprises a hollow housing or body and a deformable diaphragm which is installed in and divides the interior of the housing into a pumping chamber and a second chamber which is normally sealed from the pumping chamber. The housing defines a plurality of gaps connecting the second chamber with the atmosphere and being dimensioned and configurated to prevent the propagation of ignition so that partial or complete destruction of the diaphragm or termination of sealing engagement between the housing and the diaphragm, with attendant penetration of a combustible medium from the pumping chamber into the second chamber, and eventual ignition of the medium in the second chamber does not result in the propagation of ignition from the second chamber to the surrounding atmosphere. Such gaps constitute the sole connections between the second chamber and the atmosphere. The housing can comprise a head having first and second sections, and the diaphragm includes a marginal portion which can be sealingly installed between the two sections of the head.

The pump further comprises means for alternately deforming the diaphragm in first and second directions to thereby respectively increase and reduce the volume of the pumping chamber. Such pump further comprises means for permitting or causing a flowable medium to enter the pumping chamber in response to an increase of the volume of the pumping chamber, and means for permitting or causing the flowable medium to leave the pumping chamber in response to a reduction of the volume of the pumping chamber. The deforming means includes a portion (preferably in the form of a reciprocable hollow cupped cylindrical member) which is adjacent to and defines with a portion of the housing one of the aforementioned gaps. Such one gap can constitute a substantially cylindrical passage, and the housing can be provided with at least one opening which connects the passage with the atmosphere. If the pump is mounted in such a way that the housing comprises an upper part and a lower part, the just mentioned opening can be provided in the lower part of the housing.

The bottom wall of the aforementioned cupped member can be connected with and then serves to deform the diaphragm in response to reciprocation of such cupped member relative to the housing. A friction bearing can be interposed between the internal surface of the cupped member and a preferably sleeve-like portion of the housing. The external surface of the cupped member is adjacent to the aforementioned cylindrical passage. The deforming means can further comprise resilient means (e.g., a coil spring which reacts against the housing) which preferably surrounds a portion of the cupped member and serves to bias the cupped member in one of the aforementioned directions (e.g., in a direction to increase the volume of the pumping chamber), and a plunger or another suitable reciprocable motion transmitting element which need not be connected to the cupped member. The motion transmitting element extends through the aforementioned sleeve of the housing and serves to intermittently move the cupped member in the other of the aforementioned first and second directions against the opposition of the resilient means.

The sections of the pump head can define a second gap which is disposed radially outwardly of the marginal portion of the diaphragm and is preferably located in a single plane.

A fastener means is normally provided to connect the sections of the pump head to one another and to an adjacent portion of the housing. Such fastener means can extend through the marginal portion of the diaphragm, and a further gap can be defined by one of the sections and the fastener means. The other section of the pump head is then disposed between the one section and the adjacent portion of the housing. The arrangement may be such that the one section of the pump head has a first bore which receives a first portion of a shank forming part of the fastener means, that the other section of the pump head has a second bore which registers with the first bore and receives a second portion of the shank, and that the adjacent housing portion has a tapped blind bore for an externally threaded portion of the shank. The further gap is defined by a surface bounding the bore of the one section and the adjacent portion of the shank.

A further gap can be defined by the head and the adjacent portion of the housing; such further gap is preferably located in a single plane.

The means for permitting or causing a flowable medium to enter the pumping chamber can comprise first conduit means, and the means for permitting or causing the flowable medium to leave the pumping chamber can comprise second conduit means. The housing and at least one of these conduit means can define an additional gap which connects the pumping chamber with the atmosphere and is dimensioned and configurated to prevent the propagation of ignition from the pumping chamber to the atmosphere. For example, the head of the housing can have first and second tapped bores, one for each of the conduit means, and the conduit means can include externally threaded portions extending into the respective tapped bores of the head. The additional gap then preferably surrounds the externally threaded portion of the one conduit means.

The novel features which are considered as characteristic of the invention are set forth in particular in the appended claims. The improved pump itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a somewhat schematic axial sectional view of a diaphragm pump which embodies one form of the invention and whose housing defines a first set of gaps connecting the pumping chamber with the surrounding atmosphere and a second set of gaps which connect the atmosphere with the second chamber.

DESCRIPTION OF THE PREFERRED EMBODIMENTS

The diaphragm pump which is shown in the drawing comprises a hollow body or housing 1 including a portion 2 which is disposed adjacent to a head 3 having an outer section 4 and an inner section 5 disposed between the section 4 and housing portion 2. The rearmost portion 1*a* of the housing 1 is connected to the portion 2 by a set of bolts, screws or analogous fasteners 2*a*. Additional fasteners 6 (only one shown) connect the sections 4, 5 of the pump head 3 to each other and to the adjacent housing portion 2. A deformable diaphragm 7 divides the interior of the housing 1 into a pumping chamber 8 and a second chamber 9. The marginal portion 7*a* of the diaphragm 7 is sealingly installed between the sections 4 and 5 of the pump head 3.

The means for deforming the diaphragm 7 in order to alternately increase and reduce the volume of the pumping chamber 8 comprises a reciprocable hollow cylindrical cupped member 11 whose bottom wall 16 is secured to the central portion of the diaphragm 7 by a screw 10. The cupped member 11 extends into the second chamber 9. The means for deforming the diaphragm 7 further comprises a resilient element 12, here shown as a coil spring, which surrounds the cylindrical portion 13 of the member 11 and reacts against an internal shoulder 2*b* of the housing portion 2 so as to urge the member 11 in a direction to the right, as viewed in the drawing. To this end, the rightmost convolution of the spring 12 bears against an external collar 11*a* of the cupped member 11, and such collar is reciprocably but sealingly connected to the housing portion 2 by an annular membrane 2*c*. A friction bearing 14 is interposed between the internal surface of the cylindrical portion 13 and a sleeve-like component 15 of the rear housing portion 1*a*. The spring 12 urges the inner side of the bottom wall 16 against a plunger-like motion transmitting element 17 which is not positively connected to the cupped member 11 and extends through the front portion of the sleeve-like part 15 as well as through an antifriction bearing 19 installed in the rear portion of the part 15. The motor (not shown) which reciprocates the element 17 has a reciprocable output element 18 shown in the right-hand portion of the drawing.

The means for admitting a flowable medium (e.g., a flammable liquid or gas) into the pumping chamber 8 when the volume of this chamber is increased by the diaphragm 7 as a result of expansion of the coil spring 12 comprises a conduit including a nipple 26 and a suction line 22 which is separably coupled to the exposed portion of the nipple 26. The nipple 26 contains two ball check valves having spherical valving elements 20 and 21 which move off their respective seats 20*a*, 21*a* when the volume of the pumping chamber 8 increases so that the medium can flow from the source (not shown), via pipe 22, nipple 26 and seats 20*a* and 21*a* into the chamber 8. When the pressure in the chamber 8 rises in response to a reduction of the volume of this chamber as a result of leftward movement of the cupped member 11 under the action of the motion transmitting element 17, the valves including the valving elements 20 and 21 close automatically to prevent the expulsion of flowable medium from the chamber 8 into the suction line 22.

The means for evacuating metered quantities of flowable medium from the chamber 8 comprises second conduit means including a nipple 29 and a pressure line 25 which is coupled to the exposed portion of the nipple 29. The nipple 29 contains two ball check valves whose spherical valving elements 23, 24 are lifted off their respective seats 23*a*, 24*a* when the pressure in the chamber 8 rises whereby the medium can flow into the line 25.

The nipple 26 has an externally threaded portion 27 extending into a tapped bore 28 of the outer section 4 of the pump head 3. Analogously, the nipple 29 has an externally threaded portion 30 extending into a tapped bore 31 of the section 4.

The lower part of the housing 1, as viewed in the drawing, has at least one opening 32 which communicates with the surrounding atmosphere and communicates with the second chamber 9 through a narrow at least partly cylindrical gap 33 (whose width is exaggerated in the drawing for the sake of clarity) which is dimensioned and configurated in such a way that ignition of a flammable medium in the chamber 9 cannot propagate itself to the surrounding atmosphere.

The gap 33 is bounded in part by the cylindrical external surface 34 of the front part of the cupped member 11 and in part by a cylindrical internal surface 35 of the housing portion 2. It will be noted that the gap 33 constitutes a cylindrical passage which surrounds the end wall 16 of the cupped member 11 and communicates with the opening 32 through a radially extending slot between the housing portion 2 and the cylindrical portion 13 of the cupped member 11. The ability of the gap 33 to prevent the propagation of ignition from the chamber 9 to the surrounding atmosphere via opening 32 is due to its minimal width and pronounced length. It has been found that the cylindrical shape of the gap 33 remains unchanged for long periods of use even though the cupped member 11 performs reciprocatory movements whenever the pump is in use. The bottom wall 16 seals the chamber 9 all the way within the housing portion 2 except for the left-hand end portion of the gap 33.

A second gap 36, which is disposed in a single plane extending at right angles to the axis of the cupped member 11, is provided between the sections 4 and 5 of the pump head 3 radially outwardly of the marginal portion 7*a* of the diaphragm 7. The gap 36 is also configurated and dimensioned in such a way that it prevents the propagation of ignition from the chamber 8 and/or 9 to the surrounding atmosphere. The radial dimension of the gap 36 is preferably pronounced, even if the abutting surfaces of sections 4 and 5 of the pump head 3 are machined with a very high degree of precision. This invariably ensures that combustion of fuel or another flammable medium in the chamber 8 and/or 9 cannot propagate itself into the surrounding atmosphere where it could initiate one or more explosions.

A third gap 37 is provided between the cylindrical shank 38 of the fastener 6 and the surface surrounding a bore 39 in the outer section 4 of the pump head 3. The configuration and dimensions of the gap 37 (this gap is a cylindrical passage) are again selected in such a way that there is no possibility of propagation of ignition from the pumping chamber 8 or second chamber 9 into the surrounding atmosphere. The bore 39 of the section 4 is in register with a bore 43 of the section 5, and the bore 43 is in register with a tapped blind bore 41 of the housing portion 2. The shank 38 has an externally threaded end portion 40 which extends into the tapped bore 41 of the housing portion 2. If the pump comprises several fasteners 6, the section 4 and each of these fasteners can define a discrete cylindrical gap 37.

Still another gap 42 (disposed in a plane which is parallel to the plane of the aforementioned gap 36, is provided between the section 5 of the pump head 3 and the adjacent portion 2 of the housing 1. This gap connects the chamber 9 with the atmosphere and its configuration and dimensions are selected with a view to prevent the propagation of ignition from chamber 9 to the area surrounding the pump. The radial dimension of the gap 42 (as measured from the bores 39, 43 and to the periphery of the section 5) is sufficient to invariably prevent the propagation of flames from the interior of the housing 1 to the surrounding atmosphere.

Additional gaps 44 and 45 are respectively defined by the outer section 4 of the pump head 3 with the nipples 26, 29. The gap 44 is bounded by the surface surrounding the tapped bore 28 and by the external thread 27 of the nipple 26. The gap 45 is bounded by the surface surrounding the tapped bore 31 and by the external thread 30 of the nipple 29. The configuration and dimensions of the gaps 44 and 45 are selected with a view to prevent the propagation of ignition from the chamber 8 to the surrounding atmosphere.

It will be noted that the chamber 9 communicates with the atmosphere by way of four gaps 33, 36, 37 and 42. These gaps constitute the sole means for connecting the chamber 9 with the atmosphere. The gaps 44 and 45 constitute the sole means for connecting the pumping chamber 8 with the atmosphere (it being assumed here that the gap 37 communicates solely with the chamber 9). Consequently, if the diaphragm 7 is destroyed or dislodged from between the sections 4, 5 of the pump head 3, so that a flammable medium can penetrate from the pumping chamber 8 into the second chamber 9, sparks cannot penetrate through the gap 33, 36, 37, 42, 44 and/or 45 to present a danger in the area around the pump housing 1. The diaphragm 7 can be destroyed as a result of a primary explosion in the system which conveys a flammable medium to or from the pumping chamber 8, and such primary explosion can cause a secondary explosion in the chamber 8 and/or 9. The aforediscussed configuration and dimensions of the various gaps prevent the development of tertiary explosion or explosions outside of the housing 1. In other words, the improved pump can be safely installed in an atmosphere which is likely to engender fires and/or explosions in response to penetration of flames or sparks into the area around the pump.

It will be readily appreciated that the dimensions and strength characteristics of the materials of which the sections 4, 5 of the pump head 3, the remaining parts of the housing 1, the cupped member 11 of the diaphragm-deforming means and the parts which supply flowable medium to and receive flowable medium from the pumping chamber 8 consist are selected with a view to ensure that an explosion in the interior of the pump head 3 will not result in a widening of the aforediscussed gaps and/or in development of additional passages for the propagation of ignition or sparks from the interior of the housing 1 into the surrounding area. For example, all parts which are to stand pronounced stresses can be made of a high-quality steel.

It has been found that the improved diaphragm pump can be used in areas where a conventional diaphragm pump cannot be employed if the conveyed medium is a flammable substance and if the area surrounding the pump is a danger zone insofar as the likelihood of explosions or fires on introduction of flames or sparks is concerned. Of course, the motor which includes the reciprocable output element 18 should also be designed with a view to prevent the penetration of sparks or flames from its interior into the surrounding atmosphere. One such motor is shown in the commonly owned copending patent application Ser. No. 459,790 filed Jan. 21, 1983. Pneumatic motors have been found to be highly satisfactory for such purposes. However, it is equally possible to employ electromagnetic means in order to effect reciprocatory movements of the motion transmitting element 17.

The placing of the coil spring 12 around the cylindrical portion 13 of the cupped member 11, and the placing of the motion transmitting element 17 into the interior of the member 11 contribute to compactness of the improved diaphragm pump, as considered in the axial direction of the housing 1. Moreover, the element 17 cannot subject the cupped member 11 to any pronounced radial stresses so that the width of the gap 33 remains uniform all the way around the external surface 34 of the cylindrical portion 13.

The provision of the opening 32 in the lower part of the housing portion 2 is desirable and advantageous in the event of pronounced leakage, i.e., when a liquid medium is free to escape from the chamber 9 via gap 33. Such medium then descends into the surrounding area and can accumulate in a suitable receptacle. For example, a liquid medium can escape if the diaphragm 7 is destroyed or develops a leak (so that the medium can flow from the chamber 8 into the chamber 9) for reasons other than an explosion in the system which delivers the medium to and receives the medium from the chamber 8.

The gap 36 between the sections 4, 5 of the pump head 3 need not necessarily be disposed in a single plane. For example, such a gap can be replaced by an undulate, zig-zag shaped or similarly configurated labyrinth-type gap whose radial dimensions can greatly exceed the radial dimensions of the gap 36 and which, therefore, represents an even more reliable ensurance against the penetration of flames or sparks from the interior of the housing 1 to the surrounding atmosphere. The provision of the gap 36 (especially if such gap is located in a single plane) might necessitate some increases in the radial dimensions of the sections 4 and 5. If this is not possible or desirable, the gap 36 can be replaced with the aforediscussed undulate gap or an analogous gap whose length is quite pronounced even if the thickness of the sections 4 and 5 is much less than in the illustrated embodiment.

As a rule, the screw 6 could be driven home with a force which would prevent any communication between the chamber 8 and/or 9 and the surrounding atmosphere. However, the provision of the aforediscussed gap 37 contributes even further to the safety of the plant which employs the improved pump and to safety of the personnel because it invariably prevents the propagation of flames or sparks along the shank 38, even if the screw 6 is loosened as a result of vibrations or for other reasons. As mentioned above, a gap 37 can be provided between the section 4 and two or more screws 6, depending on the number of fasteners which are employed to secure the sections 4, 5 to each other and to the housing portion 2.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A diaphragm pump, especially for metering combustible media, comprising a hollow housing; and a diaphragm installed in and dividing the interior of said housing into a pumping chamber and a second chamber which is normally sealed from said pumping chamber, said housing defining a olurality of gaps connecting said second chamber with the atmosphere and being dimensioned and configurated to prevent the propagation of ignition so that destruction of said diaphragm, with attendant penetration of a combustible medium from said pumping chamber into said second chamber, and eventual ignition of the combustible medium in said second chamber does not result in propagation of ignition from the second chamber to the atmosphere, said gaps constituting the sole means connecting said second chamber with the atmosphere.

2. The pump of claim 1, wherein said housing includes a pump head having first and second sections and said diaphragm has a marginal portion sealingly installed between said sections, said sections defining one of said gaps and said one gap being disposed radially outwardly of said marginal portion.

3. The pump of claim 2, wherein said one gap is disposed in a single plane.

4. The pump of claim 1, wherein said housing comprises a head and said diaphragm is installed in said head, said housing further comprising a portion adjacent to and defining with said head one of said gaps.

5. The pump of claim 4, wherein said one gap is disposed in a single plane.

6. The pump of claim 1, further comprising first conduit means for admitting a flowable medium into and second conduit means for evacuating such medium from said pumping chamber, said housing and at least one of said conduit means defining an additional gap which connects said pumping chamber with the atmosphere and is dimensioned and configurated to prevent the propagation of ignition from said pumping chamber into the atmosphere.

7. The pump of claim 6, wherein said housing has tapped bores, one for each of said conduit means, and said conduit means include externally threaded portions extending into the respective bores, said additional gap surrounding the threaded portion of said one conduit means.

8. The pump of claim 1, wherein said housing includes a pump head having first and second sections and said diaphragm has a marginal portion sealingly installed between said sections and further comprising fastener means connecting said sections and extending through said marginal portion, one of said sections and said fastener means defining one of said gaps.

9. The pump of claim 8, wherein said housing further includes a portion adjacent to the other of said sections, said other section being disposed between said one section and said portion of said housing.

10. The pump of claim 9, wherein said one section has a first bore and said fastener means includes a shank received in said first bore, said other section having a second bore in register with said first bore and said portion of said housing having a tapped blind bore in register with said second bore, said shank extending through said second bore and including an externally threaded portion extending into said tapped bore.

11. The pump of claim 10, wherein said one section has an internal surface surrounding said first bore and said one gap is disposed between such internal surface and the shank of said fastener means.

12. The pump of claim 1, wherein said housing includes a pump head having first and second sections and said diaphragm is installed between said sections.

13. The pump of claim 1, further comprising means for alternately deforming said diaphragm in first and second directions to thereby respectively increase and reduce the volume of said pumping chamber, means for admitting a flowable medium into said pumping chamber in response to an increase of the volume of said pumping chamber, and means for permitting the flowable medium to leave said pumping chamber in response to a reduction of the volume of said pumping chamber.

14. The pump of claim 13, wherein said deforming means includes a portion which extends into said second chamber and said housing includes a portion adjacent to and defining with said portion of said deforming means one of said gaps.

15. The pump of claim 14, wherein said one gap includes a substantially cylindrical passage and said housing has at least one opening connecting said passage with the atmosphere.

16. The pump of claim 14, wherein said housing has an upper part and a lower part, said lower part having an opening connecting said one gap with the atmosphere.

17. The pump of claim 14, wherein said portion of said deforming means includes a substantially cylindrical reciprocable hollow cupped member having a bottom wall connected to said diaphragm.

18. The pump of claim 17, further comprising a friction bearing interposed between said cupped member and said housing, said cupped member having an external surface which is adjacent to said passage and said housing including a second portion which is surrounded by said bearing.

19. The pump of claim 17, wherein said deforming means further comprises resilient means surrounding a portion of said cupped member and arranged to bias the latter in one of said directions, said deforming means also comprising a reciprocable motion transmitting element extending through the second portion of said housing and arranged to intermittently move said cupped member in the other of said directions.

20. The pump of claim 19, wherein said resilient means includes a coil spring which reacts against said housing.

* * * * *